US007009332B2

(12) United States Patent
Jeong

(10) Patent No.: US 7,009,332 B2
(45) Date of Patent: Mar. 7, 2006

(54) SHADOW MASK STRUCTURE FOR CATHODE RAY TUBE

(75) Inventor: Hoon Jeong, Kyeongsangbuk-Do (KR)

(73) Assignee: LG. Philips Displays Korea Co., Ltd., Do (KR)

( * ) Notice: Subject to any disclaimer, the term of this patent is extended or adjusted under 35 U.S.C. 154(b) by 172 days.

(21) Appl. No.: 10/698,478

(22) Filed: Nov. 3, 2003

(65) Prior Publication Data

US 2004/0263046 A1 Dec. 30, 2004

(30) Foreign Application Priority Data

Jun. 26, 2003 (KR) ..... 10-2003-0042225

(51) Int. Cl.
*H01J 29/80* (2006.01)

(52) U.S. Cl. ..... 313/402; 313/461; 313/477 R

(58) Field of Classification Search ..... 313/402, 313/407, 408, 477 R, 461
See application file for complete search history.

(56) References Cited

U.S. PATENT DOCUMENTS 6,528,935 B1 * 3/2003 Wakasono et al. ..... 313/461
6,690,106 B1 * 2/2004 Yoshida et al. ..... 313/461
6,774,553 B1 * 8/2004 Pyun et al. ..... 313/477 R
6,841,927 B1 * 1/2005 Lee ..... 313/474
2003/0222562 A1 * 12/2003 Jeon et al. ..... 313/402

* cited by examiner

*Primary Examiner*—Joseph Williams
*Assistant Examiner*—Kevin Quarterman
(74) *Attorney, Agent, or Firm*—Birch, Stewart, Kolasch & Birch

(57) ABSTRACT

A cathode ray tube comprising a panel of which an outer surface is substantially flat and an inner surface has a certain curvature, and a shadow mask arranged with a certain interval from an inner surface of the panel and having a plurality of apertures through which electron beams pass, wherein the shadow mask satisfied a condition of $0.9 \leqq ZmD/(ZmX+ZmY) \leqq 1.1$, in which an arbitrary point on a diagonal axis of the shadow mask is supposed to be Dr, points on a long axis and a short axis meeting with perpendiculars drawn to the long axis and the short axis from the point Dr are respectively supposed to be Xr and Yr, and intervals between the respective points Xr, Yr, and Dr and the shadow mask in a tube axis direction are respectively supposed to be ZmX, ZmY, and ZmD.

25 Claims, 6 Drawing Sheets

SHADOW MASK STRUCTURE FOR CATHODE RAY TUBE

BACKGROUND OF THE INVENTION

1. Field of the Invention

This nonprovisional application claims priority under 35 U.S.C. § 119(a) on Patent Application No. 10-2003-0042225 filed in KOREA on Jun. 26, 2003, the entire contents of which are hereby incorporated by reference.

The present invention relates to a cathode ray tube, and more particularly, to a cathode ray tube capable of enhancing a characteristic of a shadow mask by optimizing a structural strength of the shadow mask.

2. Description of the Conventional Art

A cathode ray tube is a device for converting an electric signal into an electron beam and emitting the electron beam to a phosphor screen to realize an image. The cathode ray tube is widely used in the conventional art since excellent display quality is achieved at an affordable price.

A cathode ray tube will be explained with reference to attached drawings. FIG. 1 is a schematic view showing an example of a cathode ray tube of the conventional art. As shown in FIG. 1, the cathode ray tube includes a panel 101 of a front glass; a funnel 102 of a rear glass engaged to the panel 101 for forming a vacuum space; a phosphor screen 113 deposited on an inner surface of the panel 101 and serving as a phosphor; an electron gun 106 for emitting an electron beam 105 which makes the phosphor screen 113 emit light; a deflection yoke 107 mounted at an outer circumference surface of the funnel 102 with a predetermined interval for deflecting the electron beam 105 to the phosphor screen 113; a shadow mask 108 installed at a constant interval from the phosphor screen 113; a mask frame 109 for fixing and supporting the mask 108; and an inner shield 110 extending from the panel 101 to the funnel 102 for shielding external terrestrial magnetism and thus preventing deterioration of color purity by the magnetism.

Also, as shown in FIG. 2, the shadow mask 108 includes a perforated portion 108*b* formed as a dome shape of a predetermined curvature and having a plurality of apertures 108*a* through which the electron beam 105 passes, and a skirt portion 108*c* extending from a periphery of the perforated portion 108*b* in the tube axis (Z-axis) direction for being fixed to the mask frame 109.

In the conventional cathode ray tube, the electron beam 105 emitted from the electron gun 106 is deflected by the deflection yoke 107, passes through the plurality of apertures 108*a* of the shadow mask 108, and lands on the phosphor screen 113 deposited on the inner surface of the panel 101. Accordingly, the deflected electron beam 105 makes the phosphor formed at the phosphor screen 113 emit light, thereby achieving an image.

According to a recent trend of the cathode ray tube, the cathode ray tube becomes large, and a curved type panel that an inner surface and an outer surface have a small radius of curvature as shown in FIG. 3 is changing to a flat type panel that an outer surface is substantially flat as shown in FIG. 4.

Accordingly, as the panel 101 becomes large and its outer surface becomes substantially flat, a wedge ratio (%), a ratio of a peripheral thickness Td to a central thickness Tc (Td/Tc) of the panel 101 becomes great. According to this, a difference of an optical transmittance between a center and a periphery of the panel 101 becomes great and thus brightness of a screen becomes uneven. Also, as the panel 101 becomes large and its outer surface becomes substantially flat, a size of the shadow mask 108 also becomes large.

Therefore, a curvature of the shadow mask 108 having a dome shape with maintaining a certain interval from an inner surface of the panel 101 becomes flat and a structural strength of the shadow mask 108 is lowered, thereby degrading an impact resistance of the shadow mask 108.

Meanwhile, in order to improve the unevenness of brightness of the panel 101, a tinted glass which makes a glass of the panel 101 have an optical transmittance ratio of 45%~75% is applied to the panel 101 without a processing such as a coating on the panel 101. However, in case of the panel 101 to which the tinted glass is applied, an optical transmittance becomes lower from a center towards a periphery of the panel 101, and thus a uniformity of brightness is lowered. Accordingly, in order to solve this problem, to reduce a weight of the panel 101, and to reduce a damage in a thermal processing due to a difference of the thickness of the panel 101, in case that a center thickness of the panel is 10 mm~12.5 mm, a method for reducing the wedge ratio as approximately 170%~210% is considered. That is, by reducing the wedge ratio, a peripheral thickness of the panel 101 is reduced thus to increase an optical transmittance of the periphery of the panel 101 and to improve the brightness uniformity characteristic at the center and periphery of the panel 101. However, when the wedge ratio of the panel 101 is reduced, the inner surface of the panel 101 becomes flatter and thereby a curvature of the shadow mask 108 having a dome shape with maintaining a certain interval from the inner surface of the panel 101 becomes flatter thus to degrade a structural strength of the shadow mask 108. According to this, the impact resistance of the shadow mask 108 is more degraded.

Also, even if a method for reducing a thickness of the shadow mask 108 to reduce a weight thereof and a material cost is considered, there is a limitation to reduce the thickness of the shadow mask 108, and therefore, it is not sufficient due to a degradation of the structural strength of the shadow mask 108.

Therefore, a shadow mask capable of preventing the impact resistance thereof from being degraded by optimizing the structural strength of the shadow mask is much required in case that the panel becomes flat and large, in case that the tinted glass is applied to the panel, and in case that the thickness of the shadow mask is reduced.

SUMMARY OF THE INVENTION

Therefore, an object of the present invention is to provide a cathode ray tube capable of increasing an impact resistance of a shadow mask by optimizing a structural strength of the shadow mask by controlling radii of curvature of the shadow mask in directions of a long axis, a short axis, and a diagonal axis of the shadow mask in a cathode ray tube that an outer surface of a panel is substantially flat and an inner surface has a certain curvature.

To achieve these and other advantages and in accordance with the purpose of the present invention, as embodied and broadly described herein, there is provided a cathode ray tube comprising a panel of which an outer surface is substantially flat and an inner surface has a certain curvature, and a shadow mask arranged with a certain interval from an inner surface of the panel and having a plurality of apertures through which electron beams pass, wherein the shadow mask satisfied a condition of $0.9 \leqq ZmD/(ZmX+ZmY) \leqq 1.1$, in which an arbitrary point on a diagonal axis of the shadow mask is supposed to be Dr, points on a long axis and a short axis meeting with perpendiculars drawn to the long axis and the short axis from the point Dr are respectively supposed to be Xr and Yr, and intervals between the respective points Xr, Yr, and Dr and the shadow mask in a tube axis direction are respectively supposed to be ZmX, ZmY, and ZmD.

To achieve these and other advantages and in accordance with the purpose of the present invention, as embodied and broadly described herein, there is also provided a cathode ray tube comprising a panel of which an outer surface is substantially flat and an inner surface has a certain curvature, and a shadow mask arranged with a certain interval from an inner surface of the panel and including a perforated portion being formed with a plurality of apertures through which electron beams pass, wherein if a functional formula of a respective lines connecting a maximum value and a minimum value of a respective radii of curvature of the perforated portion of the shadow mask in the directions of a long axis, a short axis, and a diagonal axis of the shadow mask from a center towards a periphery is supposed to be $y=Ax+B$, the shadow mask satisfies a condition of $-5.0 \leqq A \leqq -1.0$, in which y denotes a radius of curvature, x denotes a distance from the center of the shadow mask to a position on the long axis, the short axis or the diagonal axis, A denotes a gradient, and B denotes a constant.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Reference will now be made in detail to the preferred embodiments of the present invention, examples of which are illustrated in the accompanying drawings.

Figure 1:
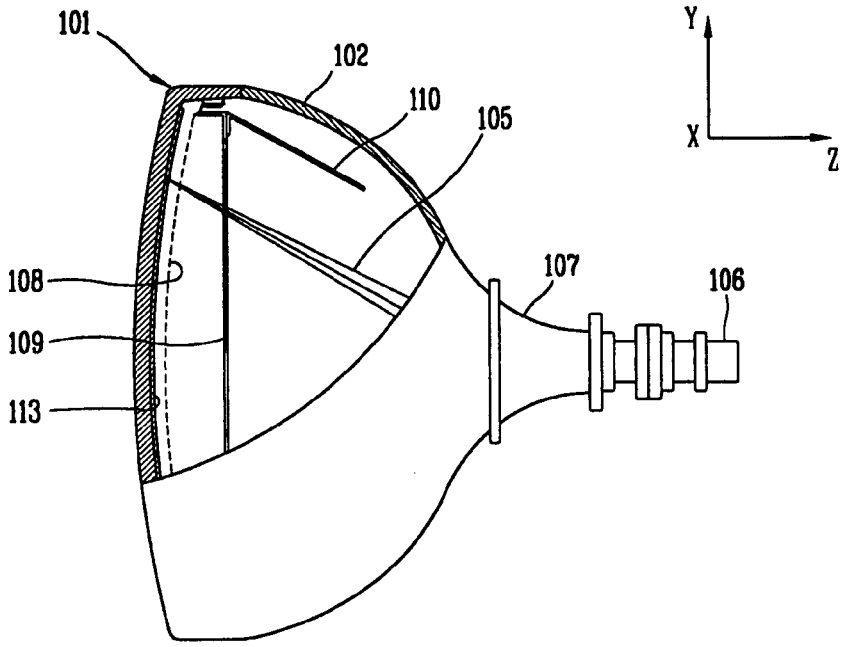
FIG. 1 CONVENTIONAL ART
FIG. 1 is a schematic view showing a cathode ray tube in accordance with the conventional art.
Figure 2:
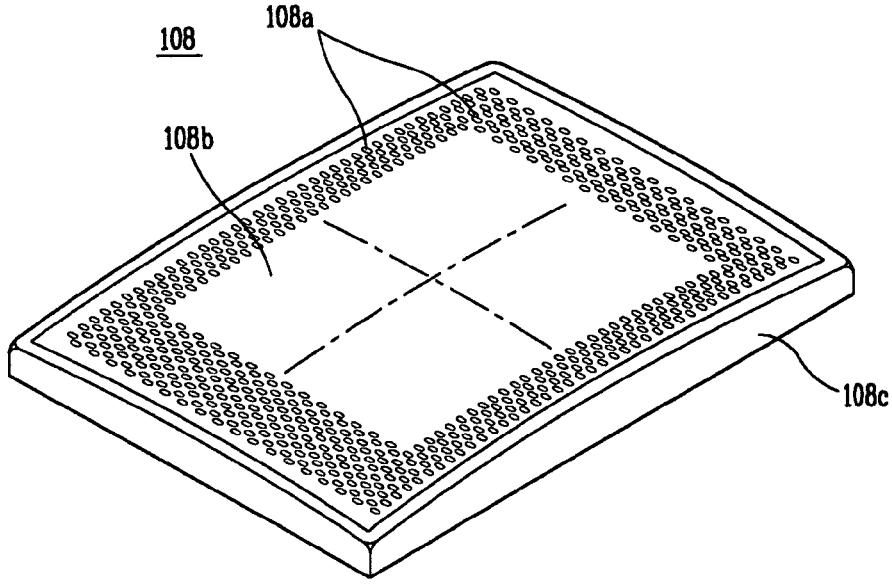
FIG. 2 CONVENTIONAL ART
FIG. 2 is a perspective view showing a shadow mask of a cathode ray tube in accordance with the conventional art.
Figure 3:
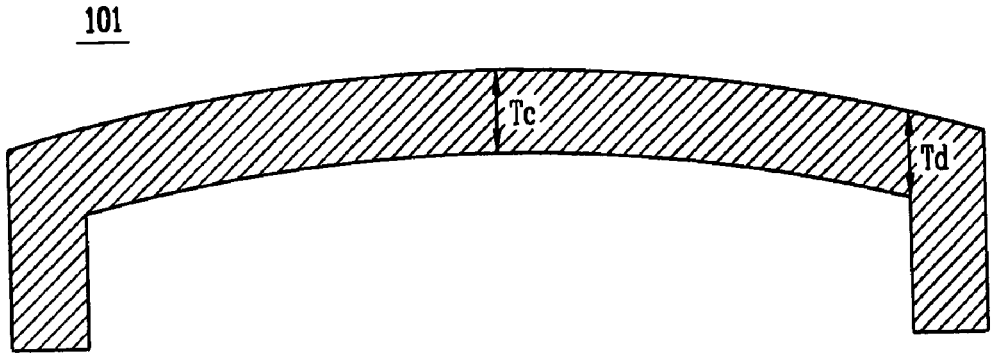
FIG. 3 CONVENTIONAL ART
FIG. 3 is a sectional view showing a non-flat type panel of a cathode ray tube in accordance with the conventional art.
Figure 4:
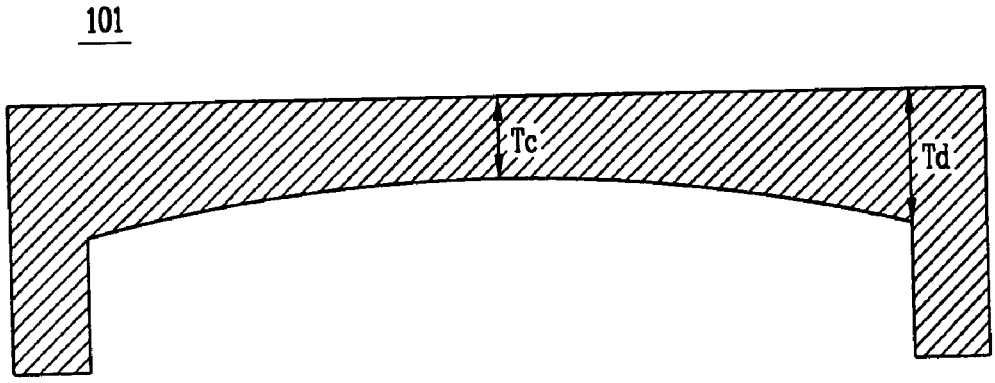
FIG. 4 CONVENTIONAL ART
FIG. 4 is a sectional view showing a flat type panel of a cathode ray tube in accordance with the conventional art.
Figure 5:
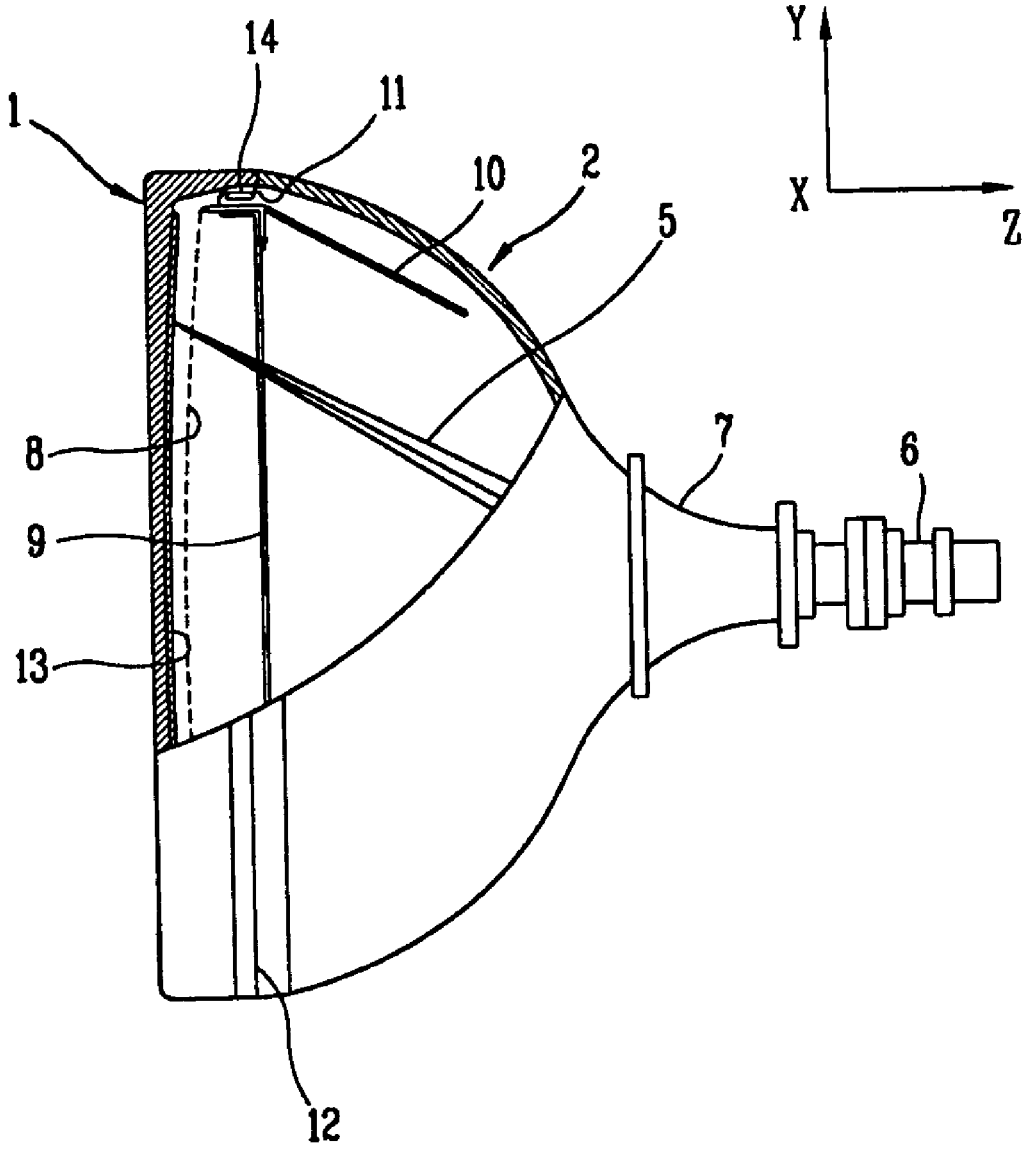
FIG. 5 is a schematic view showing a cathode ray tube according to the present invention.

As shown in FIG. 5, the cathode ray tube (CRT) includes a panel 1 of a front glass of which an outer surface is a substantially flat, and an inner surface has a predetermined curvature; a funnel 2 of a rear glass engaged to the panel 1 for forming a vacuum space; a phosphor screen 13 deposited on an inner surface of the panel 1 and serving as a phosphor; an electron gun 6 for emitting an electron beam 5 which makes the phosphor screen 13 emit light; a deflection yoke 7 mounted at an outer circumference surface of the funnel 2 with a predetermined interval for deflecting the electron beam 5 to the phosphor screen 13; a shadow mask 8 installed at a constant interval from the phosphor screen 13; a mask frame 9 for fixing and supporting the shadow mask 8; and an inner shield 10 extending from the panel 1 to the funnel 2 for shielding external terrestrial magnetism and thus preventing deterioration of color purity by the magnetism. The cathode ray tube also includes a stud pin 14 mounted at the inner side of the panel 1; a holder 11 connected to the stud pin 14 for elastically supporting the mask frame 9 to the panel 1; and a reinforcing band 12 arranged at an outer circumference of the panel 1 for distributing stress generated from the panel 1 and the funnel 2.

Figure 6:
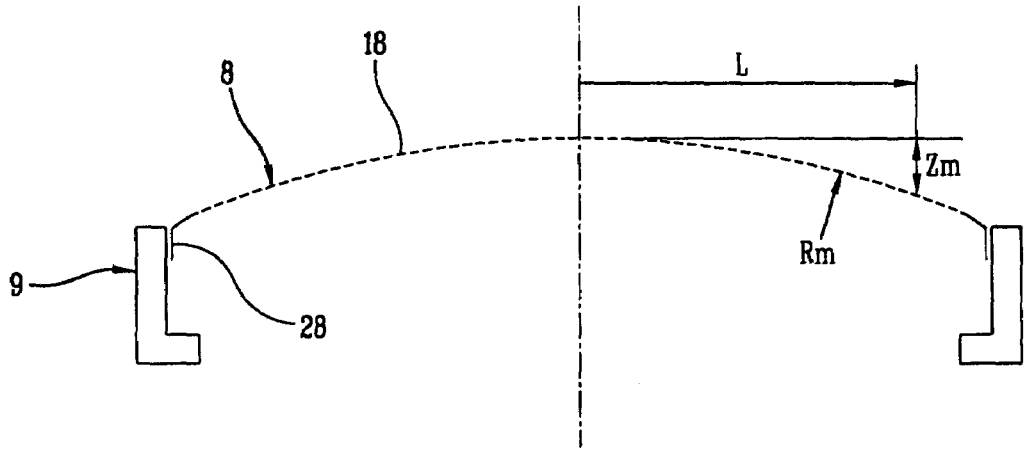
FIG. 6 is a schematic view showing a state that a shadow mask and a mask frame are assembled to each other.

As shown in FIG. 6, the shadow mask 8 includes a perforated portion 18 formed as a dome shape having a predetermined curvature and provided with a plurality of apertures through which the electron beam passes, and a skirt portion 28 extending from a periphery of the perforated portion 18 in the tube axis direction for being fixed to the mask frame 9.

The shadow mask 8 is formed of invar alloy (Fe—Ni (30~40%) based alloy) or ultra invar alloy (Fe—Ni (28~40%)-Co(1~7%) based alloy) or aluminum killed steel which have less thermal deformation. Also, a thickness T of the shadow mask 8 is formed to satisfy the following condition by considering a structural strength and an impact resistance thereof when a diagonal length of the perforated portion 18 is supposed to be Ld.

$$T \leqq Ld \times 0.00035 \quad (1)$$

A curvature of the shadow mask 8 will be explained with reference to FIG. 6. An interval in the tube axis (Z-axis) direction between a point positioned on a long axis (X-axis), a short axis (Y-axis) or a diagonal axis (D-axis) of the shadow mask and a surface of the shadow mask is supposed to be Zm, and a radius of curvature corresponding to that is supposed to be Rm. The radius Rm of curvature of a position on the surface of the shadow mask at a predetermined distance L from the center of the shadow mask 8 can be expressed as the following formula.

$$Rm=(L^2+Zm^2)/(2\times Zm) \quad (2)$$

Figure 7:
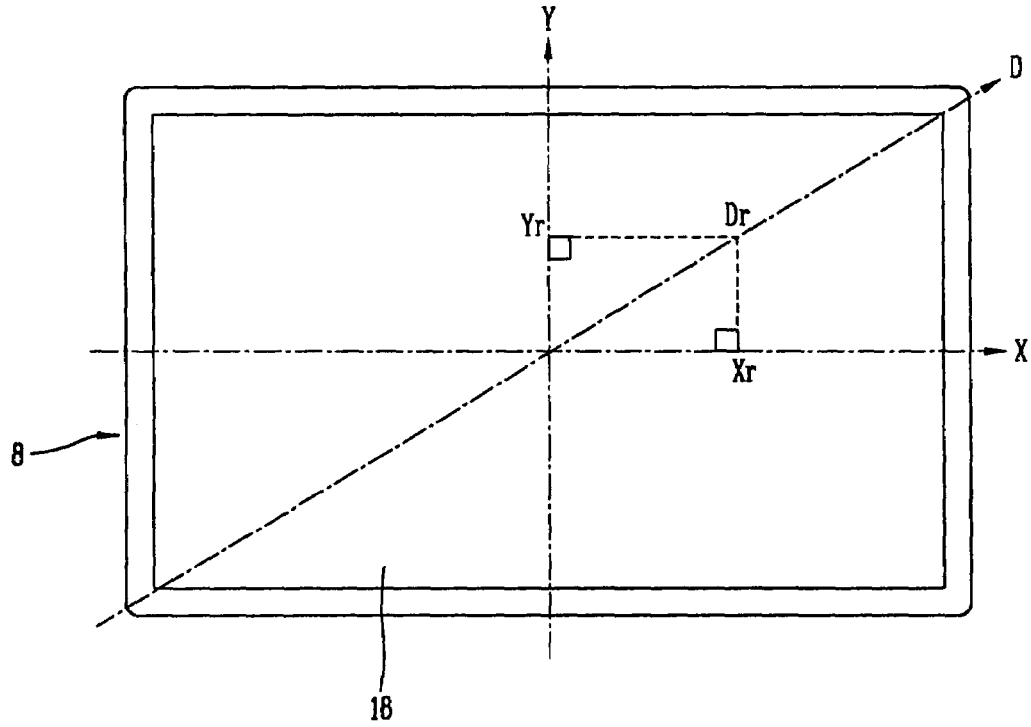
FIG. 7 is a plan view showing a shadow mask of a cathode ray tube according to the present invention.
Figure 8:
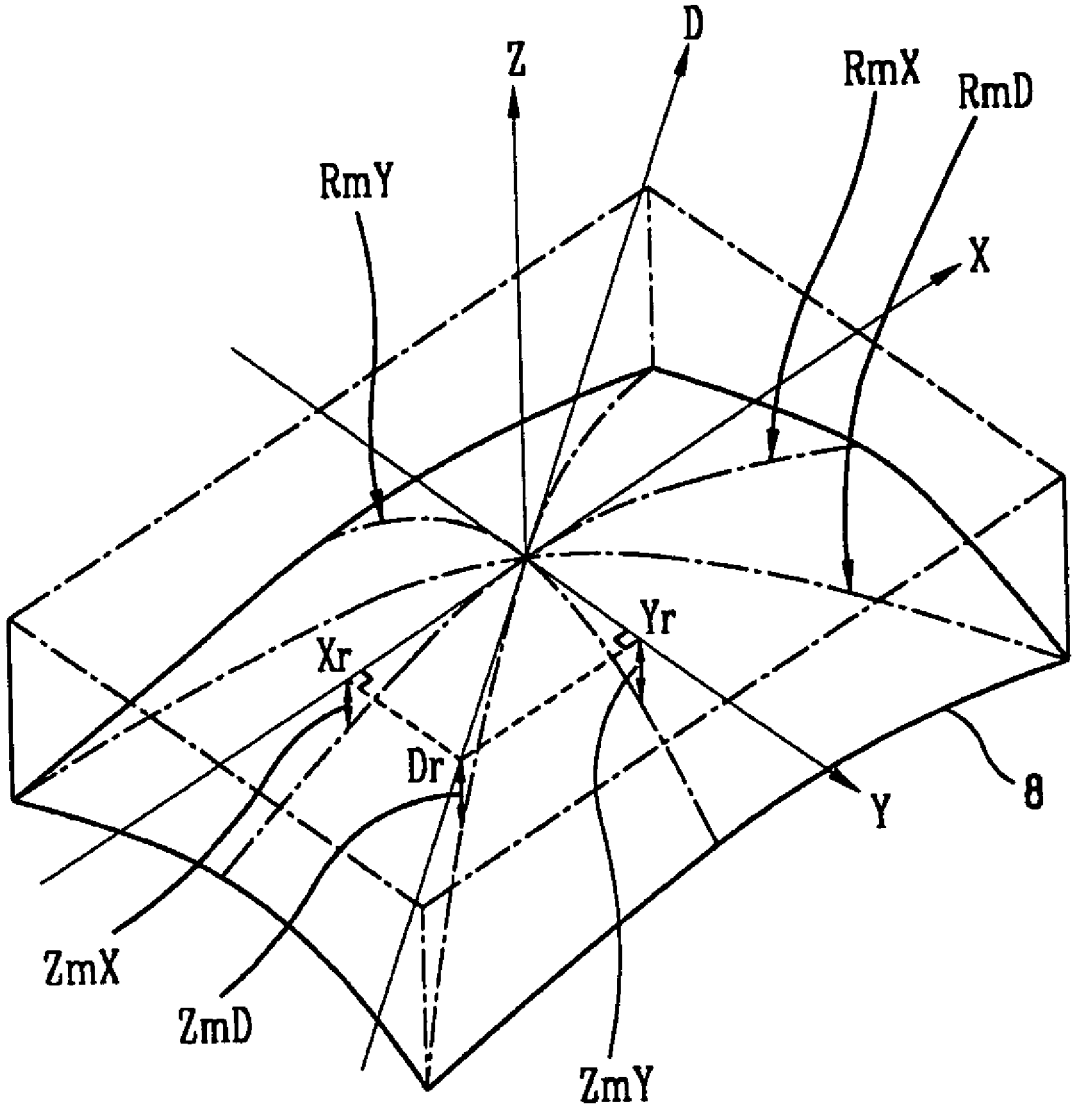
FIG. 8 is a perspective view showing curvatures corresponding to a long axis, a short axis and a diagonal axis of a shadow mask of a cathode ray tube according to the present invention.

Herein, the intervals Zm between the shadow mask 8 and the long axis (X-axis), the short axis (Y-axis), and the diagonal axis (D-axis) are respectively expressed as ZmX, ZmY and ZmD, and the radii of curvature of the perforated portion 18 of the shadow mask 8 in the directions of the long axis, the short axis and the diagonal axis are respectively expressed as RmX, RmY, and RmD. That is, as shown in FIGS. 7 and 8, when an arbitrary point on the diagonal axis of the shadow mask 8 is supposed to be Dr and points on the long axis and the short axis meeting with perpendiculars respectively drawn to the long axis and the short axis from the point Dr are supposed to be respectively Xr and Yr, an interval between said three points of Xr, Yr, and Dr and the shadow mask in the tube axis direction are expressed as ZmX, ZmY, and ZmD.

Also, when a region within 10% of a length of the perforated portion 18 from a center of the perforated portion 18 of the shadow mask 8 is supposed to be a central portion, radii of curvature in the directions of the long axis (X-axis), the short axis (Y-axis) and the diagonal axis (D-axis) at the central portion of the shadow mask 8 are respectively expressed as RmXC, RmYC, and RmDC. Also, when a region in a range of more than 90% of a length of the perforated portion 18 from the center of the perforated portion 18 is supposed to be a peripheral portion, radii of curvature in the direction of the long axis (X-axis), the short axis (Y-axis) and the diagonal axis (D-axis) at the peripheral portion of the shadow mask 8 are respectively expressed as RmXE, RmYE, and RmDE.

As the shadow mask 8 has a dome shape, the inner surface of the panel 1 has a curved surface similar to the shadow mask 8. A main role of the shadow mask 8 is to pass three electron beams 5 emitted from the electron gun 6 through the apertures formed in the perforated portion 18 of the shadow mask 8, and to correctly land to a predetermined position of the phosphor screen 13 deposited on the inner surface of the panel 1, that is, a center of R, G, and B phosphor. To this end, the shadow mask 8 has to maintain a dome shape by corresponding to the phosphor screen 13 of the inner surface of the panel 1, and has to maintain a curved surface even for an external impact or stimulus.

As aforementioned, the shadow mask 8 has to maintain its structural strength and a curvature even in a flat type cathode ray tube where a center thickness of the panel 1 is 10 mm~12.5 mm and a wedge ratio is 170%~210% or in a large cathode ray tube where a dimension ratio of the panel is 4:3 and a size of an effective surface of the panel 1 on which the phosphor screen 13 is deposited is 650 mm~720 mm. Also, the shadow mask 8 has to optimize its structural strength even in case that the thickness thereof is reduced to 0.22 mm or less in order to reduce a weight of the shadow mask 8 and a material cost, and thus an impact resistance has to be prevented from being degraded.

Geometrically, as a radius of curvature of the shadow mask 8 becomes small, strength for maintaining a curvature of the shadow mask 8 from an external impact becomes great. Also, the structural strength of the shadow mask 8 is greatly influenced by a curvature in the directions of the long axis (X axis), the short axis (Y axis) and the diagonal axis (D axis). Especially, the entire strength of is the shadow mask 8 is greatly influenced by the curvature in the diagonal axis (D axis) direction since the diagonal axis is longer than the long and short axis.

A deformation of the shadow mask 8 by an external impact is mainly generated at the periphery rather than the center of the shadow mask. Therefore, in order to have high strength at the periphery of the shadow mask 8, it is preferable to design a radius of curvature to be large at the center of the shadow mask and gradually decreased towards the periphery of the shadow mask. Also, in case that a maximum radius of curvature or a minimum radius of curvature exists between the center of the shadow mask 8 and the periphery, an inflection point of the variation of the radius of curvature therebetween can be a weak point by an external impact. Accordingly, the shadow mask 8 has to be designed to have the largest radius of curvature at the center and to have a radius of curvature gradually decreased towards the periphery.

Especially, since the shadow mask 8 is formed as a rectangular shape, the short axis thereof has a comparatively shorter distance up to an end portion of the perforated portion 18 than the longer axis or the diagonal axis. Accordingly, in order to have high strength at the short axis in which the weakest curvature exists, it is preferable that a radius of curvature at a position on the shadow mask 8 corresponding to the short axis is smaller than radii of curvature at positions on the shadow mask 8 corresponding to the long axis and the diagonal axis when the positions corresponding to the long axis, the short axis and the diagonal axis have the same distance from a center of the shadow mask 8.

Also, a curvature of the panel 1 should be changed in accordance with the curvature of the shadow mask 8 and radii of curvature in the respective axial directions of the shadow mask 8. Therefore, the radius of curvature corresponding to the short axis of the panel 1 is preferably designed to be the smallest among radii of curvature corresponding to the long axis, the short axis and the diagonal axis of the panel 1, and a radius of curvature corresponding to the long axis of the panel 1 is preferably designed to be larger than a radius of curvature corresponding to the diagonal axis of the panel 1. That is, when the radii of curvature corresponding to the long axis, the short axis and the diagonal axis of the panel 1 are supposed to be Rpx, Rpy, and Rpd, respectively, it is preferable to satisfy a following formula.

$$Rpy < Rpd \leqq Rpx \tag{3}$$

Experimental values in the following table 1 show the structural strength for each type of the shadow mask 8, which were obtained by differentiating a curvature of the shadow mask 8 as three types in the same condition and by performing an impact experiment. Herein, when the shadow masks of three types freely dropped from a free dropping experiment device by differentiating a height, heights that a deformation is generated at a curved surface of the shadow mask 8 were compared and thus used to judge the strength of the shadow mask 8.

TABLE 1

| | Embodiment | Example 1 | Example 2 |
|---|---|---|---|
| ZmXE (mm) | 13.47 | 14.12 | 13.38 |
| ZmYE (mm) | 8.28 | 10.50 | 8.37 |
| ZmDE (mm) | 20.11 | 21.07 | 18.66 |
| ZmDE/(ZmXE + ZmYE) | 0.92 | 0.86 | 0.86 |
| height (mm) | 200 | 190 | 160 |

As shown in the table 1, when shadow masks of the embodiment of the present invention and the example 2 in which the interval ZmXE at the long axis (X-axis) and the interval ZmYE at the short axis (Y-axis) are approximately similar to each other are compared with each other, the shadow mask of the example 2 where the interval ZmDE at the diagonal axis (D-axis) is lower than that of the embodiment of the present invention has a deformation at a lower height than the shadow mask of the embodiment of the present invention.

Also, even though the shadow mask of the example 1 has the intervals ZmXE, ZmYE and ZmDE at the long axis (X axis), the short axis (Y axis) and the diagonal axis (D axis) which are all greater than those of the embodiment of the present invention, the interval balance ZmDE/

(ZmXE+ZmYE) was lower than that of the shadow mask of the embodiment of the present invention and the shadow mask of the example 1 had a deformation at a lower height than the shadow mask of the embodiment of the present invention.

From said experimental results, it can be seen that the structural strength of the shadow mask 8 is lowered in case that a curvature on the diagonal axis of the shadow mask 8 is below a predetermined value. Also, the structural strength of the shadow mask 8 is also lowered in case the interval ZmD at the diagonal axis in the tube axis direction is smaller than the interval ZmX and ZmY at the long axis and the short axis even if the curvature on the diagonal axis is more than the predetermined value.

Also, in case that the interval balance ZmDE/(ZmXE+ZmYE) is smaller than 0.9, the shadow mask can be weak by an external impact. Therefore, in order to improve the structural strength of the shadow mask 8, the interval balance ZmDE/(ZmXE+ZmYE) has to be set as 0.9 or more. Also, it is more preferable to set the interval valance ZmDE/(ZmXE+ZmYE) to be approximately 1.0.

Meanwhile, in case that the interval valance ZmDE/(ZmXE+ZmYE) becomes greater than 1.1 as the interval ZmDE at the diagonal axis (D-axis) of the shadow mask 8 becomes great, high structural strength of the shadow mask 8 can be obtained. However, as an interval at an end of the diagonal axis becomes great and thus a thickness of a periphery of the panel 1 becomes thick, brightness of the periphery of the panel 1 is lowered. Accordingly, it is preferable to set the interval balance ZmDE/(ZmXE+ZmYE) of the shadow mask as 1.1 or less.

Said contents can be expressed as formulas as follows. As shown in FIG. 8, if an arbitrary point on the diagonal axis of the shadow mask 8 is supposed to be Dr, points on the long axis and the short axis meeting with perpendiculars respectively drawn to the long axis and the short axis from the point Dr are supposed to be respectively Xr and Yr, and an interval in the tube axis direction between the three points of Xr, Yr, and Dr and the shadow mask are supposed to be ZmX, ZmY, and ZmD, the following condition is preferably satisfied.

$$0.9 \leqq ZmD/(ZmX+ZmY) \leqq 1.1 \quad (4)$$

Also, as aforementioned, the optimum interval balance ZmD/(ZmX+ZmY) to increase a structural strength of the shadow mask is set to be 0.9 or more and to be smaller than 1.0.

$$0.9 \leqq ZmD/(ZmX+ZmY) \leqq 1.0 \quad (5)$$

Each radius of curvature corresponding to the long axis (X-axis), the short axis (Y-axis) and the diagonal axis (D-axis) of the shadow mask 8 which satisfy the above mentioned conditions will be explained as follows.

Figure 9:
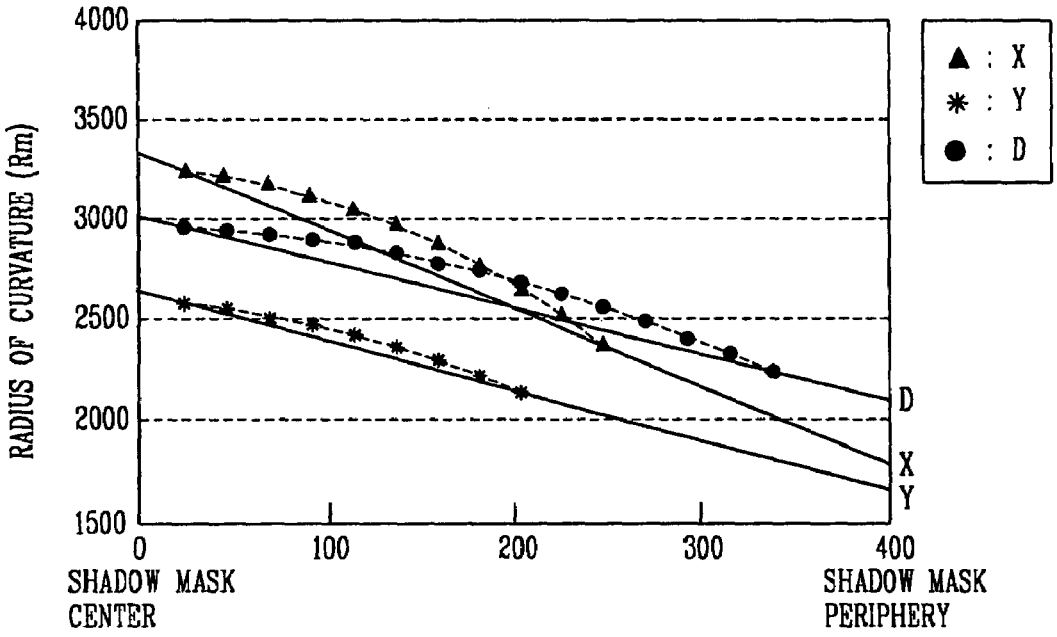
FIG. 9 is a graph showing variations of radii of curvature of a shadow mask from a center towards a periphery in a long axis direction, a short axis direction and a diagonal axis direction of the shadow mask in a cathode ray tube according to the present invention.

FIG. 9 is a graph showing variations of radii of curvature of a shadow mask 8 from a center towards a periphery in a long axis direction, a short axis direction and a diagonal axis direction of the shadow mask in a cathode ray tube according to the present invention.

As shown in FIG. 9, each radius of curvature corresponding to the long axis, the short axis and the diagonal axis of the shadow mask 8 becomes gradually small towards the periphery of the shadow mask 8 from the center thereof. Also, when a region within 10% of a length of the perforated portion 18 in the long axis direction, the short axis direction and the diagonal axis direction of the shadow mask 8 is supposed to be a central portion, and a region in a range of more than 90% of the length of the perforated portion 18 is supposed to be a peripheral portion, the radius of curvature of the central portion is greater than the radius of curvature of the peripheral portion by more than 200 mm.

Also, in the central portion of the shadow mask, the radius of curvature of the shadow mask 8 in the direction of the long axis RmXC is the greatest, the radius of curvature in the direction of the diagonal axis RmDC is the next, and the radius of curvature in the direction of the short axis RmYC is the smallest. This can be expressed as a following formula.

$$RmYC \leqq RmDC \leqq RmXC \quad (6)$$

Also, among radii of curvature corresponding to the respective axes, which varies from the center towards the periphery of the shadow mask 8, the radius of curvature in the direction of the long axis has the greatest variation width. That is, a gradient of a line connecting a maximum value and a minimum value of the radius of curvature corresponding to the long axis from the center towards the periphery of the shadow mask is less than a gradient of a line connecting a maximum value and a minimum value of the radius of curvature corresponding to the diagonal axis. Further, a gradient of a line connecting a maximum value and a minimum value of the radius of curvature in the direction of the long axis is less than a gradient of a line connecting a maximum value and a minimum value of the radius of curvature in the direction of the short axis. This can be expressed as a following formula.

$$Ax < Ay \quad (7)$$

$$Ax < Ad \quad (8)$$

Herein, Ax denotes a gradient of a line connecting a maximum value and a minimum value of the radius of curvature in the direction of the long axis from the center towards the periphery of the shadow mask, Ay denotes a gradient of a line connecting a maximum value and a minimum value of the radius of curvature in the direction of the short axis from the center towards the periphery of the shadow mask, and Ad denotes a gradient of a line connecting a maximum value and a minimum value of the radius of curvature in the direction of the diagonal axis from the center towards the periphery of the shadow mask.

Also, the lines connecting a maximum value and a minimum value of the respective radii of curvature in the directions of the long axis and the diagonal axis are crossed to each other from the center towards the periphery of the shadow mask. In the peripheral portion of the shadow mask, the radius RmDE of curvature in the direction of the diagonal axis is the greatest, the radius RmXE of curvature in the direction of the long axis is the next, and the radius RmYE of curvature in the direction of the short axis is the smallest.

Here, a functional formula of a line connecting a maximum value and a minimum value of each radius of curvature in the directions of the long axis, the short axis and the diagonal axis from the center towards the periphery of the shadow mask, that is, a functional formula denoting a radius of curvature at a position spaced with a predetermined distance from the center of the shadow mask is supposed to be y=Ax+B. The A denoting a gradient is in a range of −5.0 ~−1.0. Further, in case that the optimum interval balance ZmD/(ZmX+ZmY) is applied, the A is in a range of −4.0~−2.0.

Figure 10:
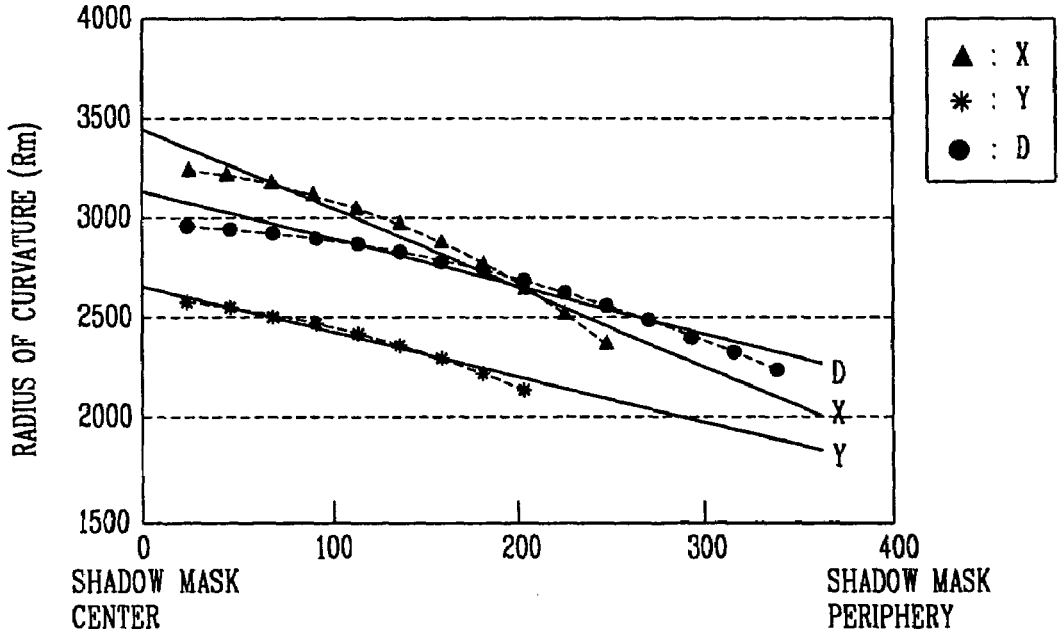
FIG. 10 is a graph showing variations of radii of curvature of a shadow mask from a center towards a periphery in a long axis direction, a short axis direction and a diagonal axis direction of the shadow mask and showing trend lines in a cathode ray tube according to the present invention.

As shown in FIG. 10, even if a variation curved line of the radius of curvature in the respective directions of the long axis, the short axis and the diagonal axis from the center towards the periphery of the shadow mask is made to be near a straight line by using a method of least squares, a straight line denoting a variation trend of the radius of curvature in the direction of the long axis of the shadow mask and a straight line denoting a variation trend of the radius of curvature in the direction of the short axis are crossed to each other.

In the cathode ray tube according to the present invention, the radii of curvature in the directions of the long axis, the short axis, and the diagonal axis of the shadow mask are optimized thus to increase a structural strength of the shadow mask, thereby increasing an impact resistance of the shadow mask.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. A cathode ray tube comprising:

a panel of which an outer surface is substantially flat and an inner surface has a certain curvature; and a shadow mask arranged with a certain interval from an inner surface of the panel and having a plurality of apertures through which electron beams pass, wherein the shadow mask satisfied a condition of $0.9 \leqq ZmD/(ZmX+ZmY) \leqq 1.1$, in which an arbitrary point on a diagonal axis of the shadow mask is supposed to be Dr, points on a long axis and a short axis meeting with perpendiculars drawn to the long axis and the short axis from the point Dr are respectively supposed to be Xr and Yr, and intervals between the respective points Xr, Yr, and Dr and the shadow mask in a tube axis direction are respectively supposed to be ZmX, ZmY, and ZmD.

2. The cathode ray tube of claim 1, wherein the shadow mask satisfies a condition of $0.9 \leqq ZmD/(ZmX+ZmY) \leqq 1.0$.

3. The cathode ray tube of claim 1, wherein a radius of curvature of the shadow mask in a direction of the diagonal axis of the shadow mask is gradually decreased from a center of the shadow mask towards a periphery of the shadow mask.

4. The cathode ray tube of claim 3, wherein if a functional formula of respective lines connecting a maximum value and a minimum value of a respective radii of curvature in directions of the long axis, the short axis and the diagonal axis of the shadow mask from a center towards a periphery is supposed to be $y=Ax+B$, the shadow mask satisfies a condition of $-5.0 \leqq A \leqq -1.0$, in which y denotes a radius of curvature, x denotes a distance from the center of the shadow mask to a position the long axis, the short axis or the diagonal axis, A denotes a gradient of the lines, and B denotes a constant.

5. The cathode ray tube of claim 4, wherein the shadow mask satisfies a condition of $-4.0 \leqq A < -2.0$.

6. The cathode ray tube of claim 1, wherein a radius of curvature at a position on the shadow mask corresponding to the short axis is the smallest among radii of curvature at positions corresponding to the long axis, the short axis and the diagonal axis, when the positions on the shadow mask have the same distance from a center of the shadow mask.

7. The cathode ray tube of claim 1, wherein the shadow mask satisfies a condition of $T \leqq Ld \times 0.00035$, in which Ld denotes a diagonal length of a perforated surface thereof in which the apertures is formed, and T denotes a thickness of the shadow mask.

8. The cathode ray tube of claim 1, wherein a thickness of the shadow mask is 0.22 mm or less.

9. The cathode ray tube of claim 1, wherein an optical transmittance ratio of a center portion of the panel is 45%~75%.

10. The cathode ray tube of claim 1, wherein a wedge ratio of a thickness of an end portion of the diagonal axis of the panel to a thickness of a center portion of the panel is 170%~210%.

11. The cathode ray tube of claim 1, wherein a thickness of a center portion of the panel is 10 mm~12.5 mm.

12. The cathode ray tube of claim 1, wherein the panel satisfies a condition of $Rpy < Rpd \leqq Rpx$, in which Rpx, Rpy, and Rpd respectively denotes radii of curvature of the panel in directions of a long axis, a short axis and a diagonal axis of the panel.

13. The cathode ray tube of claim 1, wherein the shadow mask satisfies a condition of $Rmy \leqq Rmd \leqq Rmx$, in which Rmx, Rmy, and Rmd respectively denotes radii of curvature of the shadow mask in directions of the long axis, the short axis, and the diagonal axis at a center portion of the shadow mask.

14. A cathode ray tube comprising:

a panel of which an outer surface is substantially flat and an inner surface has a certain curvature; and a shadow mask arranged with a certain interval from an inner surface of the panel and having a plurality of apertures through which electron beams pass, wherein a dimension ratio of the panel is 4:3, a size of an effective surface of the panel on which a phosphor screen is deposited is 650 mm~720 mm, and the shadow mask satisfies a condition of $0.9 \leqq ZmD/(ZmX+ZmY) \leqq 1.1$, in which an arbitrary point on a diagonal axis of the shadow mask is supposed to be Dr, points on a long axis and a short axis meeting with perpendiculars drawn to the long axis and the short axis from the point Dr are respectively supposed to be Xr and Yr, and intervals between the respective points Xr, Yr, and Dr and the shadow mask in a tube axis direction are respectively supposed to be ZmX, ZmY, and ZmD.

15. The cathode ray tube of claim 14, wherein a radius of curvature of the shadow mask in a direction of the diagonal axis of the shadow mask is gradually decreased from a center towards a periphery of the shadow mask.

16. The cathode ray tube of claim 15, wherein if a functional formula of respective lines connecting a maximum value and a minimum value of a respective radii of curvature in the directions of the long axis, the short axis and the diagonal axis of the shadow mask from a center towards a periphery is supposed to be $y=Ax+B$, the shadow mask satisfies a condition of $-5.0 \leqq A \leqq -1.0$, in which y denotes a radius of curvature, x denotes a distance from the center of the shadow mask to a position on the long axis, the short axis or the diagonal axis, A denotes a gradient of the lines, and B denotes a constant.

17. The cathode ray tube of claim 14, wherein a radius of curvature at a position on the shadow mask corresponding to the short axis is smaller than radii of curvature at positions on the shadow mask corresponding to the long axis or the diagonal axis when the positions corresponding to the long axis, the short axis and the diagonal axis have the same distance from a center of the shadow mask.

18. The cathode ray tube of claim 14, wherein a thickness of the shadow mask is 0.22 mm or less.

19. The cathode ray tube of claim 14, wherein an optical transmittance ratio of a center portion of the panel is 45%~75%.

20. The cathode ray tube of claim 14, wherein a thickness of a center portion of the panel is 10 mm~12.5 mm.

21. The cathode ray tube of claim 14, wherein the panel satisfies a condition of $Rpy<Rpd \leqq Rpx$, in which Rpx, Rpy, and Rpd denote a respective radii of curvature of panel in directions of a long axis, a short axis and a diagonal axis of the panel.

22. The cathode ray tube of claim 14, wherein the shadow mask satisfies a condition of $Rmy \leqq Rmd \leqq Rmx$, in which Rmx, Rmy, and Rmd respectively denotes radii of curvature of the shadow mask in directions of the long axis, the short axis, and the diagonal axis at a center portion of the shadow mask.

23. The cathode ray tube of claim 14, wherein the shadow mask is formed of at least one of Fe—Ni based alloy, Fe—Ni—Co based alloy, or aluminum killed steel.

24. A cathode ray tube comprising:

a panel of which an outer surface is substantially flat and an inner surface has a certain curvature; and a shadow mask arranged with a certain interval from an inner surface of the panel and having a plurality of apertures through which electron beams pass, wherein if a functional formula of a respective lines connecting a maximum value and a minimum value of a respective radii of curvature in directions of a long axis, a short axis and a diagonal axis of the shadow mask from a center towards a periphery is supposed to be $y=Ax+B$, the shadow mask satisfies a condition of $-5.0 \leqq A \leqq -1.0$, in which y denotes a radius of curvature, x denotes a distance from the center of the shadow mask to a position on the long axis, the short axis or the diagonal axis, A denotes a gradient of the lines, and B denotes a constant.

25. The cathode ray tube of claim 24, wherein the shadow mask satisfies a condition of $-4.0 \leqq A \leqq -2.0$.

* * * * *